US011386815B2

(12) United States Patent
Brasher

(10) Patent No.: US 11,386,815 B2
(45) Date of Patent: Jul. 12, 2022

(54) BYPASS MERGE LANES

(71) Applicant: Robert C. Brasher, Fremont, CA (US)

(72) Inventor: Robert C. Brasher, Fremont, CA (US)

( * ) Notice: Subject to any disclaimer, the term of this patent is extended or adjusted under 35 U.S.C. 154(b) by 53 days.

(21) Appl. No.: 15/428,588

(22) Filed: Feb. 9, 2017

(65) Prior Publication Data

US 2017/0362787 A1 Dec. 21, 2017

Related U.S. Application Data

(60) Provisional application No. 62/352,987, filed on Jun. 21, 2016.

(51) Int. Cl.

| | |
|---|---|
| ***E01F 1/00*** | (2006.01) |
| ***G09F 7/00*** | (2006.01) |
| ***E01F 15/00*** | (2006.01) |
| ***E01F 9/50*** | (2016.01) |
| ***E01C 1/02*** | (2006.01) |

(52) U.S. Cl.

CPC ..... *G09F 7/00* (2013.01); *E01C 1/02* (2013.01); *E01F 9/50* (2016.02); *E01F 15/006* (2013.01)

(58) Field of Classification Search

CPC . E01F 9/588; E01F 9/608; E01F 13/04; E01F 13/046; E01F 15/006; G06F 7/00

USPC ..... 404/1, 6, 9

See application file for complete search history.

(56) References Cited

U.S. PATENT DOCUMENTS

| | | | | |
|---|---|---|---|---|
| 5,498,100 | A * | 3/1996 | Guernsey | E01F 15/006 404/6 |
| 7,739,030 | B2 * | 6/2010 | Desai | B60N 2/01 340/907 |
| 8,864,408 | B1 * | 10/2014 | Dyke | B60P 3/40 404/73 |
| 9,457,216 | B2 * | 10/2016 | Lagree | A63B 21/0004 |
| 2004/0091313 | A1 * | 5/2004 | Zhou | E01C 1/002 404/1 |
| 2007/0048084 | A1 * | 3/2007 | Jung | G09F 9/30 404/9 |
| 2009/0052983 | A1 * | 2/2009 | Goj | E01C 1/04 404/1 |
| 2009/0060647 | A1 * | 3/2009 | Denison | E01C 1/02 404/1 |
| 2011/0243657 | A1 * | 10/2011 | Yeo | E01C 1/04 404/1 |

OTHER PUBLICATIONS

Google Maps, Liberia Ave, Manassas, VA 2014; 1 page (Year: 2014).*

* cited by examiner

*Primary Examiner* — Raymond W Addie

(57) ABSTRACT

A system to improve the management of through traffic and vehicles entering and exiting a multilane roadway. The lanes are separated by at least one lane separator which should not be crossed by traffic along a designated portion of the roadway, such as within a predetermined distance from a roadway entrance or exit. The at least one lane separator may be any lane marking, barrier, or the like. The at least one lane separator can be any length and located anywhere with respect to the lanes.

20 Claims, 7 Drawing Sheets

BYPASS MERGE LANES

CROSS-REFERENCE TO RELATED PATENT APPLICATION

This application claims the benefit of U.S. Provisional Patent Application No. 62/352,987 filed on Jun. 21, 2016, entitled BYPASS MERGE LANES, the disclosure of which is hereby incorporated herein in its entirety by this reference.

BACKGROUND OF THE INVENTION

1. Field of the Invention

The present invention relates to the field of vehicular traffic management. Generally, the present invention relates to management of through traffic in the presence of vehicles entering and exiting a roadway.

2. Description of the Prior Art

Roadways such as freeways typically have multiple lanes of traffic in each direction. At certain locations along a multilane roadway, entrances and exits are provided to allow vehicles to enter and exit the roadway. Often other vehicles are traveling on the roadway, and vehicles entering the roadway must safely merge into traffic while vehicles exiting the roadway must safely maneuver to exit the roadway.

Through traffic is often impeded due to traffic congestion in the vicinity of an entrance or exit of the roadway. Furthermore, vehicles entering the roadway into traffic can present a safety risk for both through traffic and the motorists exiting the roadway. Also, vehicles exiting the roadway present a safety risk for both through traffic and motorists entering the roadway. The risk is increased by motorists changing lanes in the vicinity of an entrance or exit to avoid traffic congestion.

SUMMARY OF THE INVENTION

The present invention has as an object to provide a system to improve the management of through traffic in the vicinity of an entrance or exit where vehicles enter or exit a multilane roadway. Various examples of the system in accordance with the present invention manage vehicular traffic on a roadway with multiple lanes in at least one direction. The lanes are separated by one or more lane separators which should not be crossed by through traffic or vehicles entering or exiting the roadway along a designated portion of the roadway, such as within a predetermined distance from an entrance or exit provided for vehicles to enter or exit the roadway. The lane separators may be any lane marking, barrier, or the like. The lane separators may be any length and located anywhere with respect to the lanes. Additionally, signage is preferably provided to alert motorists of upcoming lane separators for managing traffic proximate an entrance or exit.

BRIEF DESCRIPTION OF THE DRAWING

The various examples of the present invention will be described in conjunction with the accompanying figures of the drawing to facilitate an understanding of the present invention. In the drawing:

FIG. 9, comprising

DETAILED DESCRIPTION OF THE PREFERRED EXAMPLES

Figure 1:
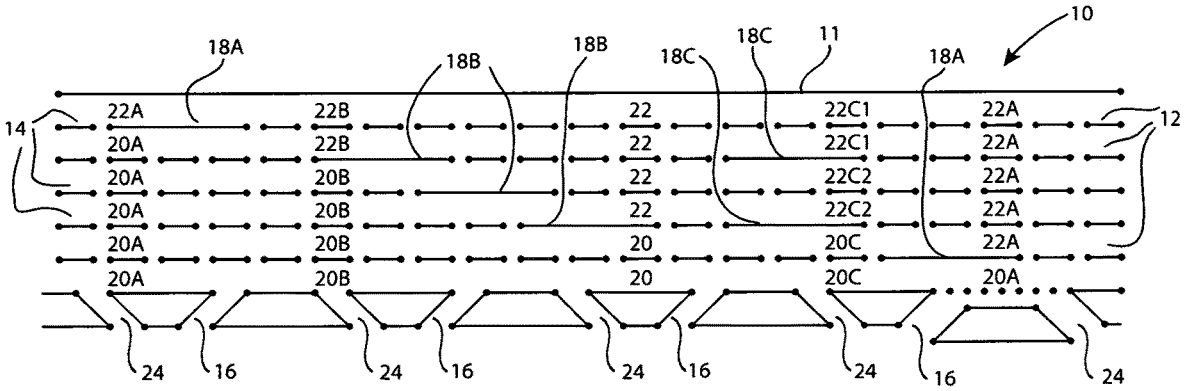
FIG. 1 is an elevational view of a multilane roadway for management of vehicular traffic at one or more entrances and exits to a roadway in accordance with an example of the present invention.

An example of the multilane roadway management system 10 in accordance with the present invention is shown in FIG. 1. A roadway 11 comprises a plurality of lanes 12 in one direction, for example, six lanes, as shown in FIG. 1. The lanes 12 are preferably marked by lane marking 14 to define each of the lanes, for example, by conventional striping in the form of dashed line segments to designate the lanes.

As shown in FIG. 1, one or more entrances 16 are provided to allow vehicles to enter the roadway 11. In accordance with the example of the present invention shown in FIG. 1, one or more lane separators 18 is provided to divide the roadway 11 into one or more merge lanes 20 and one or more bypass lanes 22 proximate to the one or more entrances 16 or exits 24. The one or more lane separators 18 should not be crossed by through traffic or merging or exiting vehicles along the portion of the roadway where the lane separator(s) is/are present. The one or more lane separators 18 may be any lane marking, barrier, or the like. The one or more lane separators 18 may be any length and located anywhere with respect to the lanes 12. As shown in FIG. 1, for example, the one or more lane separators 18 may be a lane marking consisting of a solid line of striping distinguishable from the dashed line segments 14 of striping that define the lanes 12.

The multilane roadway management system 10 provides one or more lane separators 18 which vehicles should not cross between the bypass lanes 22 designated for through traffic and the merge lanes 20 to reduce traffic congestion and to improve the safety of the roadway 11 for both through traffic and vehicles entering and exiting the roadway at the entrances 16 and exits 24. The merge lanes 20 are those lanes proximal to an entrance 16 (i.e., closer to an entrance) or exit 24 (i.e., closer to an exit) for motorists entering or exiting the roadway 11, respectively. The bypass lanes 22 are those lanes distal from the entrance 16 (i.e., farther from the entrance) or exit 24 (i.e., farther from the exit) on the other side of the merge lanes 20 for through traffic on the roadway 11.

As shown in FIG. 1, in accordance with one example of the present invention, one or more lane separators 18A may be provided to separate the lanes 12 into merge lanes 20A and bypass lanes 22A at one or more predetermined locations along the roadway 11. In accordance with another example, lane separators 18B may partially overlap to alter the number of merge lanes 20B and bypass lanes 22B at one or more other predetermined locations along the roadway 11. In accordance with a further example, lane separators 18C may entirely overlap at one or more predetermined locations along the roadway 11 to manage through traffic into merge lanes 20C and bypass lanes 22C, with the lane separators 18C establishing multiple corridors (e.g., two corridors) of bypass lanes 22C1 and 22C2.

If there is an exit 24 in proximity to one or more of the entrances 16, the multilane roadway management system 10 preferably provides appropriate roadway signage to alert motorists approaching the exit that they need to maneuver their vehicles into the merge lanes 20 and be prepared to exercise caution, including reducing their speed, to safely allow motorists entering the roadway 11 to merge into traffic at the entrance(s) 16 while allowing motorists exiting the roadway to safely exit without impeding through traffic.

Figure 2:
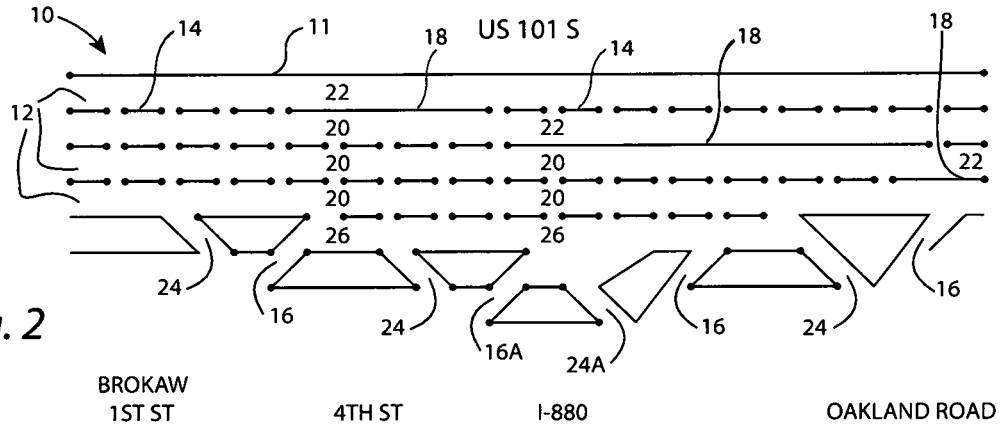
FIG. 2 is an elevational view of another example of a multilane roadway for management of vehicular traffic at one or more entrances and exits to a roadway in accordance with the present invention.

Referring to FIG. 2, an example of the multilane roadway management system 10 is shown where multiple entrances 16 and exits 24 are spaced along the roadway 11. As shown in FIG. 2, lane separators 18 having various lengths divide the roadway 11 into merge lanes 20 and bypass lanes 22 in the vicinity of the entrances 16 and exits 24. The bypass lanes 22 begin where the conventional striping in the form of dashed line segments 14 to define the lanes 12 of the multilane roadway 11 transitions to lane marking consisting of a solid line, for example. The positioning of the lane separators 18 is determined by the spacing of the entrances 16 to allow motorists entering the roadway 11 to safely merge into through traffic while accommodating motorists entering the roadway at a subsequent entrance 16 to merge onto the roadway after initially entering an additional entrance/exit lane 26. In instances where an entrance such as entrance 16A is in close proximity to an exit such as exit 24A, the number of merge lanes 20 is sufficient to allow entering and exiting vehicles to safely enter and exit the roadway 11 with minimal effect on through traffic which is restricted to bypass lanes 22.

Figure 3:
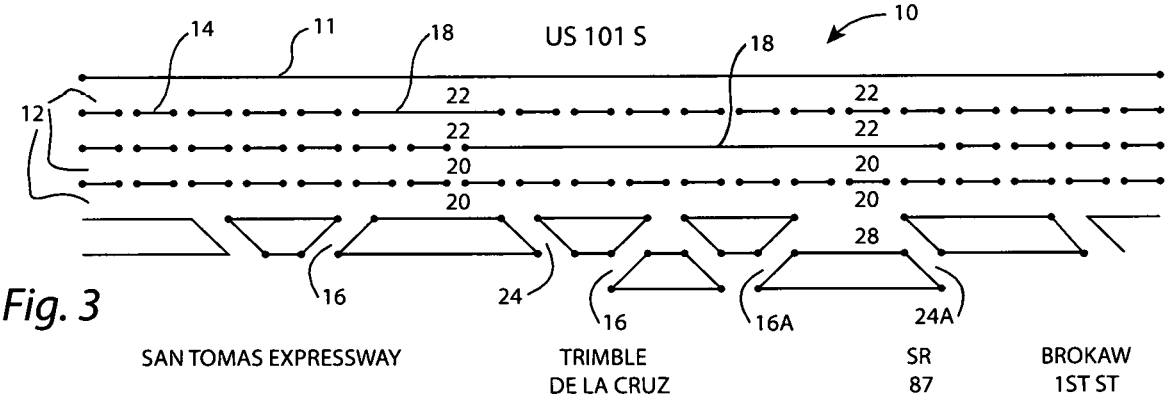
FIG. 3 is an elevational view of an additional example of a multilane roadway for management of vehicular traffic at one or more entrances and exits to a roadway in accordance with the present invention.

Referring to FIG. 3, an example of the multilane roadway management system 10 is shown where multiple entrances 16 and exits 24 are spaced along the roadway 11. As shown in FIG. 3, lane separators 18 having various lengths divide the roadway 11 into merge lanes 20 and bypass lanes 22 in the vicinity of the entrances 16 and exits 24. The bypass lanes 22 begin where the conventional striping in the form of dashed line segments 14 to define the lanes 12 of the multilane roadway 11 transitions to lane marking consisting of a solid line, for example. The positioning of the lane separators 18 is determined by the spacing of the entrances 16 to allow motorists entering the roadway 11 to safely merge into through traffic while accommodating motorists entering the roadway at a subsequent entrance 16 to safely merge onto the roadway after initially entering an additional entrance/exit lane 28. In instances where an entrance such as entrance 16A is in close proximity to an exit such as exit 24A, the number of merge lanes 20 is sufficient to allow entering and exiting vehicles to enter and exit the roadway 11 with minimal effect on through traffic which is restricted to bypass lanes 22.

Figure 4:
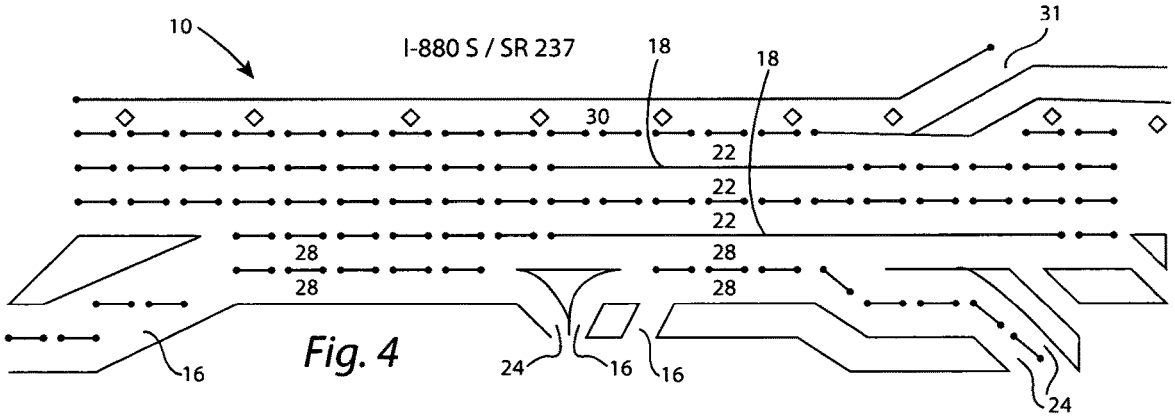
FIG. 4 is an elevational view of a further example of a multilane roadway for management of vehicular traffic at one or more entrances and exits to a roadway in accordance with the present invention.

Referring to FIG. 4, an example of the multilane roadway management system 10 is shown where multiple entrances 16 and exits 24 are spaced along the roadway 11 and a diamond lane 30 is also present to allow vehicles to exit the roadway at a flyover 31 or continue on in the diamond lane. As shown in FIG. 4, lane separators 18 having various lengths divide the roadway 11 into merge lanes 20 and bypass lanes 22 including the diamond lane 30 in the vicinity of the entrances 16 and exits 24. The bypass lanes 22 begin where the conventional striping in the form of dashed line segments 14 to define the lanes 12 of the multilane roadway 11 transitions to lane marking consisting of a solid line, for example. The positioning of the lane separators 18 is determined by the spacing of the entrances 16 to allow motorists entering the roadway 11 to safely merge into through traffic while accommodating motorists entering the roadway at a subsequent entrance 16 to safely merge onto the roadway after initially entering additional entrance/exit lanes 28. In instances where the entrances 16 are in close proximity to the exits 24, the number of merge lanes 20 is sufficient to allow entering and exiting vehicles to safely enter and exit the roadway 11 after first entering the additional entrance/exit lanes 28 with minimal effect on through traffic which is restricted to bypass lanes 22.

Figure 5:
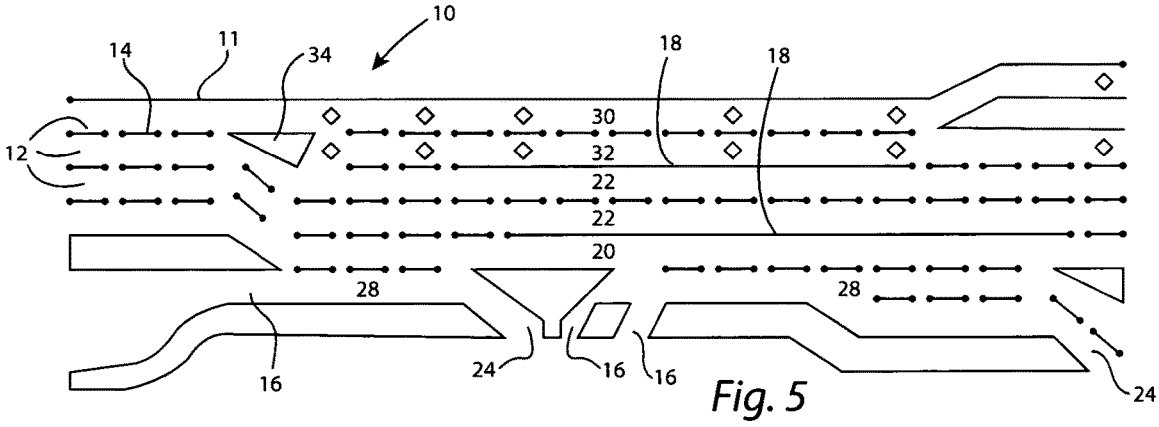
FIG. 5 is an elevational view of an alternative example of the multilane roadway for management of vehicular traffic at one or more entrances and exits to the roadway shown in FIG. 4.

Referring to FIG. 5, an example of the multilane roadway management system 10 is shown where multiple entrances 16 and exits 24 are spaced along the roadway 11 and a diamond lane 30 is also present to allow vehicles to exit the roadway. Furthermore, a diamond lane 32 is established by a roadway marking 34 for through traffic on the roadway 11. As shown in FIG. 5, lane separators 18 having various lengths divide the roadway 11 into merge lanes 20 and bypass lanes 22 including the diamond lanes 30 and 32 in the vicinity of the entrances 16 and exits 24. The bypass lanes 22 begin where the conventional striping in the form of dashed line segments 14 to define the lanes 12 of the multilane roadway 11 transitions to lane marking consisting of a solid line, for example. The positioning of the lane separators 18 is determined by the spacing of the entrances 16 to allow motorists entering the roadway 11 to safely merge into through traffic while accommodating motorists entering the roadway at a subsequent entrance 16 to merge onto the roadway after initially entering additional entrance/exit lanes 28. In instances where the entrances 16 are in close proximity to the exits 24, the number of merge lanes 20 is sufficient to allow entering and exiting vehicles to safely enter and exit the roadway 11 after first entering the additional entrance/exit lanes 28 with minimal effect on through traffic which is restricted to bypass lanes 22.

Figure 6:
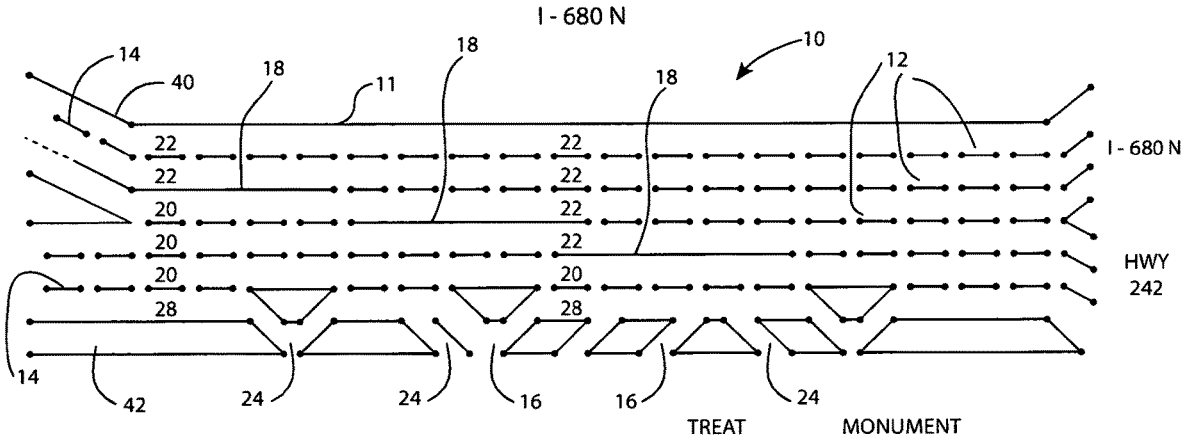
FIG. 6 is an elevational view of an example of a multilane roadway for management of vehicular traffic at one or more entrances and exits to a roadway proximate roadway junctions in accordance with the present invention.

Referring to FIG. 6, an example of the multilane roadway management system 10 is shown where the roadway 11 comprises a first multilane roadway 40 which merges with a second multilane roadway 42 and multiple entrances 16 and exits 24 are spaced along the roadway 42. As shown in FIG. 6, lane separators 18 having various lengths divide the roadways 40 and 42 into merge lanes 20 and bypass lanes 22 where the roadways 40 and 42 merge and in the vicinity of the entrances 16 and exits 24. The bypass lanes 22 begin where the conventional striping in the form of dashed line segments 14 to define the lanes 12 of the multilane roadways 40 and 42 transitions to lane marking consisting of a solid line, for example. The positioning of the lane separators 18 is determined by the merging of the multilane roadways 40 and 42 and spacing of the entrances 16 along the multilane roadway 42 to allow motorists to merge from one of the multilane roadways 40 and 42 onto the other of the multilane roadways, while accommodating motorists entering the multilane roadway 42 at entrances 16 to merge onto the roadways 40 and 42 after first entering additional entrance/exit lanes 28. In instances where the entrances 16 are in close proximity to the exits 24, the number of merge lanes 20 is sufficient to allow entering and exiting vehicles to safely enter and exit the multilane roadway 42 after entering the additional entrance/exit lanes 28 with minimal effect on through traffic which is restricted to bypass lanes 22.

Figure 7:
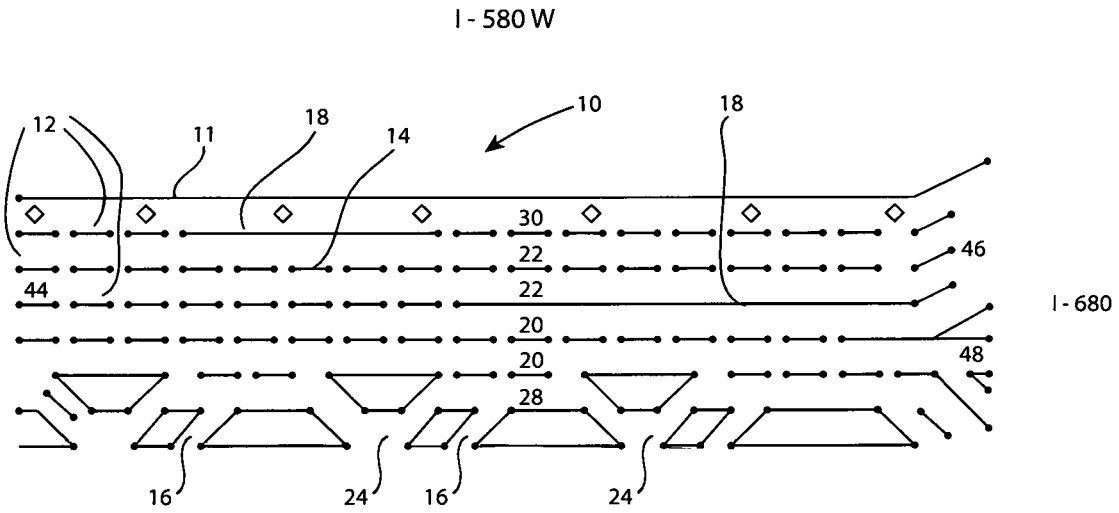
FIG. 7 is an elevational view of another example of a multilane roadway for management of vehicular traffic at one or more entrances and exits to a roadway proximate roadway junctions in accordance with the present invention.

Referring to FIG. 7, an example of the multilane roadway management system 10 is shown where the roadway 11 comprises a first multilane roadway 44 which splits into a second multilane roadway 46 and a third multilane roadway 48. Multiple entrances 16 and exits 24 are spaced along the multilane roadway 44, and a diamond lane 30 is also present. As shown in FIG. 7, lane separators 18 having various lengths divide the multilane roadway 44 into merge lanes 20 and bypass lanes 22 including the diamond lane 30 in the vicinity of the entrances 16 and exits 24. The bypass lanes 22 begin where the conventional striping in the form of dashed line segments 14 to define the lanes 12 of the multilane roadway 44 transitions to lane marking consisting of a solid line, for example. The positioning of the lane separators 18 is determined by the spacing of the entrances 16 to allow motorists entering the multilane roadway 44 to safely merge into through traffic while accommodating motorists entering the multilane roadway 44 at a subsequent entrance 16 to merge onto the multilane roadway after first entering an additional entrance/exit lane 28. In instances where the entrances 16 are in close proximity to exits 24, the number of merge lanes 20 is sufficient to allow entering and exiting vehicles to safely enter and exit the multilane roadway 44 after first entering the additional entrance/exit lane 28 with minimal effect on through traffic which is restricted to bypass lanes 22.

Figure 8:
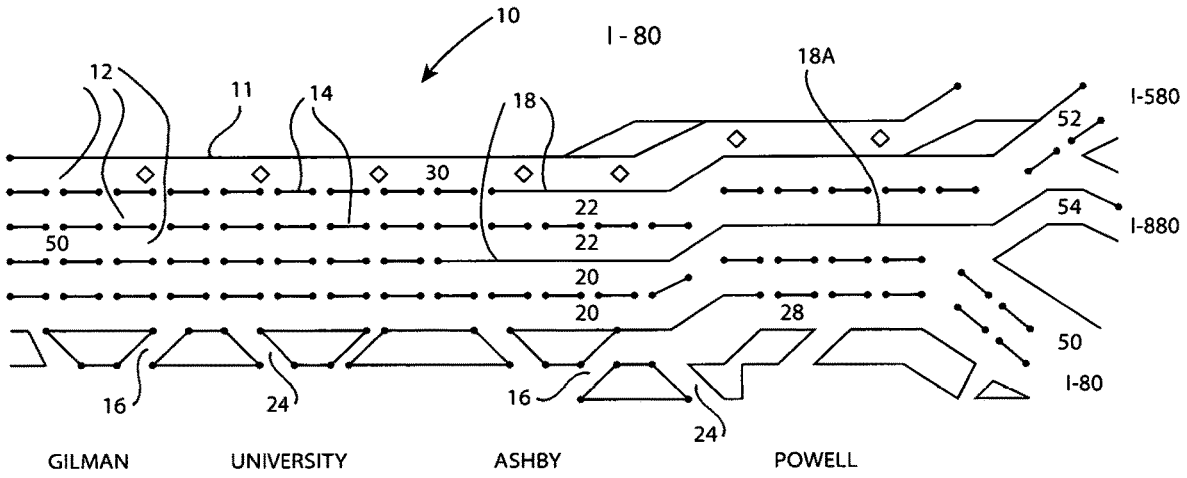
FIG. 8 is an elevational view of an additional example of a multilane roadway for management of vehicular traffic at one or more entrances and exits to a roadway proximate roadway junctions in accordance with the present invention.

Referring to FIG. 8, an example of the multilane roadway management system 10 is shown where the roadway 11 comprises a first multilane roadway 50 which splits into a second multilane roadway 52, a third multilane roadway 54, and a fourth multilane roadway 56. Multiple entrances 16 and exits 24 are spaced along the multilane roadway 50, and a diamond lane 30 is also present on roadway 50. As shown in FIG. 8, lane separators 18 having various lengths divide the multilane roadway 50 into merge lanes 20 and bypass lanes 22 including the diamond lane 30 in the vicinity of the entrances 16 and exits 24. The bypass lanes 22 begin where the conventional striping in the form of dashed line segments 14 to define the lanes 12 of the multilane roadway 50 transitions to lane marking consisting of a solid line, for example. The positioning of the lane separators 18 is determined by the spacing of the entrances 16 to allow motorists entering the multilane roadway 50 to safely merge into through traffic while accommodating motorists entering the multilane roadway 50 at a subsequent entrance 16 to merge onto the multilane roadway 50 after first entering an additional entrance/exit lane 28. In instances where the entrances 16 are in close proximity to the exits 24, the number of merge lanes 20 is sufficient to allow entering and exiting vehicles to safely enter and exit the multilane roadway 50 after entering the additional entrance/exit lane 28 with minimal effect on through traffic which is restricted to bypass lanes 22. As shown in FIG. 8, note that the lane separator 18A may promote safety by restricting motorists from entering the multilane roadway 52 after initially merging onto the multilane roadway 50.

Figure 9A:
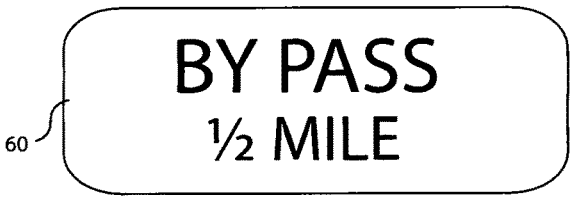
FIGS. 9A to 9C, illustrates examples of signage to alert motorists to upcoming designated traffic management portions of a roadway in accordance with the present invention.
Figure 9A:
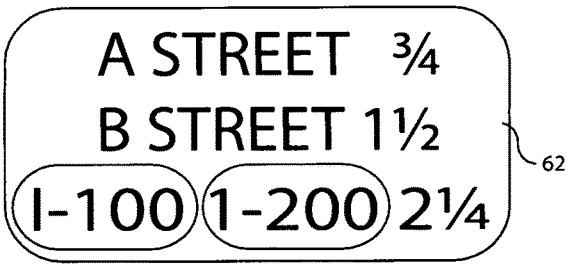
Figure 9B:
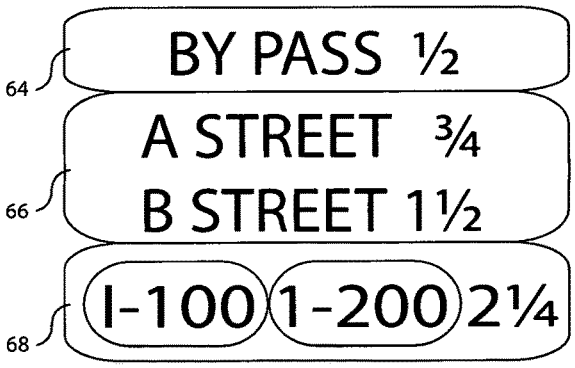
Figure 9C:
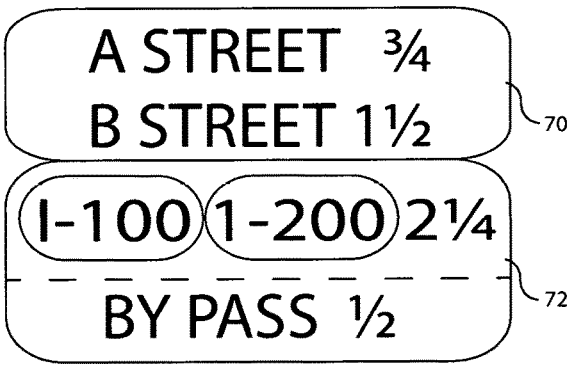

Referring to FIGS. 9A, 9B, and 9C, signage is preferably provided to alert motorists of approaching exits and related restrictions on lane changes imposed by lane separators 18 to reduce congestion by funneling through traffic into bypass lanes 22 and apprising motorists who want to exit to maneuver into merge lanes 20. As shown in FIG. 9A signage may comprise a first sign 60 to alert motorists that they are approaching a bypass lane(s) for through traffic and the distance to the bypass lane(s). A second sign 62 may be existing signage informing motorists about exits which are upcoming and the distances to those exits, as well as the distance to an upcoming roadway junction.

As shown in FIG. 9B, signage may comprise a plurality of elements that are either separate signs or integrated into one sign. The signage may comprise a first element 64 to alert motorists that they are approaching a bypass lane(s) for through traffic and the distance to the bypass lane(s). A second element 66 may be signage informing motorists about local exits which are upcoming and the distances to those exits. A third element 68 may be signage informing motorists about a roadway junction which is upcoming and the distance to the roadway junction. Note that the distance to the bypass lane(s) is less than the distance to the local exits or the roadway junction, and therefore the signage respecting the bypass lane(s) appears at the top.

As shown in FIG. 9C, signage may comprise a plurality of elements that are either separate signs or integrated into one sign. The signage may comprise a first element 70 which may be signage informing motorists about local exits which are upcoming and the distances to those exits. A second element 72 may be signage informing motorists about a roadway junction which is upcoming and the distance to the roadway junction. A third element 72 may alert motorists that they are approaching a bypass lane(s) for through traffic and the distance to the bypass lane(s). Note that the distance to the bypass lane(s) appears at the bottom to give priority to the signage for the local exits and roadway junction.

The examples described above are provided by way of example only, and various modifications apparent to persons skilled in the art are contemplated. For example, as shown in FIG. 8, instead of striping, the lane separator 18A may be a barrier installed between the lanes 12 of the roadway 11 which are vertically movable from a position with the top of the barrier flush with the surface of the roadway to a raised position extending above the surface of the roadway. Alternatively, as shown in FIG. 1, the lane separator 18A may be a moveable road zipper barrier commercially available from Lindsay Corporation located in Rio Vista, Calif.

What is claimed is:

1. A system to manage vehicular traffic on a roadway having multiple through lanes of vehicular traffic moving in the same direction to reduce congestion in the vicinity of an entrance enabling vehicles to enter the roadway, the roadway not having a High Occupancy Vehicle (HOV) or Express Lane in the vicinity of the entrance, comprising:

a roadway comprising a plurality of m through lanes of vehicular traffic moving in the same direction in the vicinity of an entrance to the roadway where m is an integer and m>2, wherein the m through lanes are delineated by dashed line segments having a given length between the lanes; and a system comprising a plurality of lane separators positioned between n of the m through lanes where n is an integer and $2 \leq n \leq m$, which should not be crossed by vehicular traffic along a designated portion of the roadway within a predetermined distance d from the entrance to the roadway;

wherein the plurality of lane separators differ from the dashed line segments delineating the m through lanes, the lane separators having a plurality of diverse predetermined lengths different from the given length and being located at predetermined positions with respect to the m through lanes to indicate that vehicular traffic should not cross any lane separator from one lane of the m through lanes in which the vehicular traffic is within the predetermined distance d from the entrance to an adjacent lane where one of the lane separators is positioned between the one lane and the adjacent lane;

wherein the plurality of lane separators define at least one of the m through lanes as an entrance bypass lane distal to the entrance to the roadway and at least one of the m through lanes as a merge lane proximal to the entrance to the roadway to enable vehicles to merge at the entrance into the at least one merge lane; and wherein the plurality of lane separators are located amongst the m through lanes to manage entry of vehicles into the at least one merge lane at the entrance to the roadway.

2. A system as recited in claim 1 wherein m=3.

3. A system as recited in claim 1 wherein m=4.

4. A system as recited in claim 1 wherein m=5.

5. A system as recited in claim 1 wherein the plurality of lane separators are in the form of solid lines of striping.

6. A system as recited in claim 1 wherein the plurality of lane separators comprise at least one barrier that is vertically movable from a position with a top of the at least one barrier flush with a surface of the roadway to a raised position extending above the surface of the roadway.

7. A system as recited in claim 1 wherein the plurality of lane separators comprise at least one moveable road zipper barrier.

8. A system as recited in claim 1, further comprising an additional entrance lane adjacent to the at least one merge lane.

9. A system as recited in claim 1, further comprising signage to alert motorists that they are approaching the at least one entrance bypass lane for through traffic and a distance to the at least one entrance bypass lane.

10. A system as recited in claim 9, further comprising signage to alert motorists that they are approaching at least one exit or roadway junction and a distance to the at least one exit or roadway junction.

11. A system to manage vehicular traffic on a roadway having multiple through lanes of vehicular traffic moving in the same direction to reduce congestion in the vicinity of an entrance enabling vehicles to enter the roadway, the roadway having at least one High Occupancy Vehicle (HOV) or Express Lane in the vicinity of the entrance and additionally having a plurality of m through lanes of vehicular traffic moving in the same direction as the traffic moving in the at least one HOV or Express Lane in the vicinity of the entrance to the roadway where m is an integer and m>2, wherein the m through lanes are delineated by dashed line segments having a given length between the lanes, the improvement comprising:

a system comprising a plurality of lane separators positioned between n of the m through lanes where n is an integer and $2 \leq n \leq m$, which should not be crossed by vehicular traffic along a designated portion of the roadway within a predetermined distance d from the entrance to the roadway;

wherein the plurality of lane separators differ from the dashed line segments delineating the m through lanes, the lane separators having a plurality of diverse predetermined lengths different from the given length and being located at predetermined positions with respect to the m through lanes to indicate that vehicular traffic should not cross any lane separator from one lane of the m through lanes in which the vehicular traffic is within the predetermined distance d from the entrance to an adjacent lane where one of the lane separators is positioned between the one lane and the adjacent lane;

wherein the plurality of lane separators define at least one of the m through lanes as an entrance bypass lane distal to the entrance to the roadway and at least one of the in through lanes as a merge lane proximal to the entrance to the roadway to enable vehicles to merge at the entrance into the at least one merge lane; and wherein the plurality of lane separators are located amongst the m through lanes to manage entry of vehicles into the at least one merge lane at the entrance to the roadway.

12. A system as recited in claim 11 wherein m=3.

13. A system as recited in claim 11 wherein m=4.

14. A system as recited in claim 11 wherein m=5.

15. A system as recited in claim 11 wherein the plurality of lane separators are in the form of solid lines of striping.

16. A system as recited in claim 11 wherein the plurality of lane separators comprise at least one barrier that is vertically movable from a position with a top of the at least one barrier flush with a surface of the roadway to a raised position extending above the surface of the roadway.

17. A system as recited in claim 11 wherein the plurality of lane separators comprise at least one moveable road zipper barrier.

18. A system as recited in claim 11, further comprising an additional entrance lane adjacent to the at least one merge lane.

19. A system as recited in claim 11, further comprising signage to alert motorists that they are approaching the at least one entrance bypass lane for through traffic and a distance to the at least one entrance bypass lane.

20. A system as recited in claim 19, further comprising signage to alert motorists that they are approaching at least one exit or roadway junction and a distance to the at least one exit or roadway junction.

* * * * *